United States Patent [19]

Kishishita et al.

[11] Patent Number: 4,731,958

[45] Date of Patent: Mar. 22, 1988

[54] SUBSTRATE FOR THIN FILM ELECTROLUMINESCENT DISPLAY PANEL

[75] Inventors: Hiroshi Kishishita; Etsuo Mizukami; Yoshihiro Endo, all of Nara; Takaaki Horita, Tenri; Hisashi Uede, Wakayama, all of Japan

[73] Assignee: Sharp Kabushiki Kaisha, Osaka, Japan

[21] Appl. No.: 819,004

[22] Filed: Jan. 14, 1986

Related U.S. Application Data

[60] Continuation of Ser. No. 535,312, Sep. 23, 1983, abandoned, which is a division of Ser. No. 296,537, Aug. 26, 1981, abandoned.

[30] Foreign Application Priority Data

Aug. 29, 1980 [JP] Japan ..... 55-120914

[51] Int. Cl.[4] ..... B24B 1/00

[52] U.S. Cl. ..... 51/283 R; 134/1; 65/30.1; 51/323; 51/310

[58] Field of Search ..... 51/283 R, 323, 310, 51/311, 312; 134/1; 65/30.1

[56] References Cited

U.S. PATENT DOCUMENTS

| | | | |
|---|---|---|---|
| 3,127,534 | 3/1964 | Diemar | 313/509 |
| 3,394,031 | 7/1968 | Ramm | 313/509 |
| 3,898,351 | 8/1975 | Kennison et al. | 134/1 |
| 4,188,565 | 2/1980 | Mitzukami et al. | 313/509 |

FOREIGN PATENT DOCUMENTS

| | | | |
|---|---|---|---|
| 0878381 | 9/1961 | United Kingdom | 51/283 R |

*Primary Examiner*—Frederick R. Schmidt
*Assistant Examiner*—Robert A. Rose
*Attorney, Agent, or Firm*—Birch, Stewart, Kolasch & Birch

[57] ABSTRACT

A glass substrate for supporting an electroluminescent (EL) display element comprising two dielectric layers defining a thin film EL layer, and two electrode layers, attached to each of the two dielectric layers is characterized by being composed of barosilicic acid without hydrolytic products thereon. A method for preparing such a glass substrate comprises the steps of preparing a glass substrate composed of borosilic acid, grinding a surface of the glass substrate, and cleaning the surface of the glass substrate without soaking it in an acidic solu tion, so that the glass substrate is free from formed hydrolytic products on the surface.

1 Claim, 7 Drawing Figures

SUBSTRATE FOR THIN FILM ELECTROLUMINESCENT DISPLAY PANEL

BACKGROUND OF THE INVENTION

This application is a continuation of copending application Ser. No. 535,312, filed Sept. 23, 1983, now abandoned, which in turn is a divisional of copending application Ser. No. 296,537, filed Aug. 26, 1981, now abandoned.

The present invention relates to an thin-film electroluminescent (referred to as "EL" hereinafter) display panel and, more particularly, to a substrate for supporting such an thin-film EL display panel.

Firstly, a conventional electroluminescent (EL) display panel representative of the prior art is illustrated in FIG. 1, wherein the EL display panel comprises a transparent glass substrate 1, a transparent electrode 2 made of $In_2O_3$, $SnO_2$ or the like formed thereon, a first dielectric layer 3 made of $Y_2O_3$, $TiO_2$, or the like, an EL thin film 4 made of ZnS:Mn, and a second dielectric layer 5 made of a similar material of the first dielectric layer 3. A counter electrode 6 is made of A1 and is formed on the second dielectric layer through evaporation techniques. The first dielectric layer 3 is provided by sputtering or electron beam evaporation techniques. The EL thin film 4 is made of ZnS thin film doped with manganese at a desired amount. An AC electric field from an AC power source 7 is applied to the transparent electrode 2 and the counter electrode 6 to activate the EL thin film 4.

An example of the above structure of the EL display panel was disclosed in, for example, U.S. Pat. No. 3,967,112 "Photo-Image Memory Panel and Activating Method Thereof" issued on June 29, 1976, assigned to the same assignee.

A surface of the transparent glass substrate 1 suitable for the EL display panel is conventionally fire-polished. The fire-polished surface provides smoothness superior to others and is used for the substrate of the EL display panel as will be described below.

Conventionally, the material of the transparent glass substrate 1 is glass made of borosilicic acid, well known by the commercial name of Pyrex glass. After the borosilicic acid glass is fire-polished, it is cut and the edges plained off. For cleaning, it is subjected to a surface active agent, a cleaning solution, and pure water. The surface of the glass is treated by being dried with freon vapor. On the thus prepared surface of the glass, a plurality of layers are in turn evaporated to make the EL display element.

A disadvantage of a fire-polished glass substrate is that it inevitably will not possess the desired flatness, showing a curve as large as about 0.5 mm average per 10 cm square. Such a curve makes it difficult to prepare uniform and flat layers of the EL display element. A sealing glass cap is conventionally attached to the glass substrate for covering the EL display element to protect the EL display element from moisture introduction from the ambient. The fire-polished unflat substrate further makes it difficult to completely seal the glass substrate by the sealing glass cap from the moisture.

Therefore, it is desirable that a different type of glass substrate suitable for the EL display element be prepared.

SUMMARY OF THE INVENTION

Accordingly, it is an object of the present invention to provide an improved substrate for supporting layers of an EL display element.

It is another object of the present invention to provide an improved method for preparing a substrate for supporting layers of an EL display element.

Briefly described, in accordance with the present invention, a glass substrate for supporting an electroluminescent (EL) display element comprising two dielectric layers defining a thin film EL layer, and two electrode layers attached to each of the two dielectric layers is characterized by being composed of borosilicic acid and excludes hydrolytic products from the surface thereof. A method for preparing such a glass substrate comprises the steps of preparing a glass substrate composed of borosilicic acid, grinding a surface of the glass substrate, and cleaning the surface of the glass substrate without soaking the substrate in conventional acidic cleaning solutions, so that the glass substrate is prepared in a manner which avoids the forming of hydrolytic products on the ground surface.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DESCRIPTION OF THE INVENTION

A glass substrate of borosilicic acid is provided, which is desirably cut and plained off at the edges. After it is subjected to a first step of primary grinding and a second step of grinding, it is preliminarily cleaned. The substrate is finally cleaned with a solution, pure water, and exposed to freon vapor for drying purpose. The second step of grinding must be carried out very carefully. The grinding precision of this step is called photo mask grade in which careful precision, more than in optical grinding, is required. Defects causing dielectric breakdown in layers of the EL display element must be removed.

Careful precision should be taken in the preliminary cleaning and the final cleaning. In these cleaning steps, heretofore a weak solution of hydrofluoric acid was used to remove materials present from abrasive grinding steps.

Usually, when a glass substrate of borosilicic acid is soaked in an acidic solution, such as hydrofluoric acid, alkali or alkaline earth components in the glass are removed from the surface so that a hydrolytic product (a film of silica gel) is formed on the surface. A film of electrode material such as $In_2O_3$ or the like is formed on such a glass substrate. Electrode strips are prepared from the film by etching. During the etching step, the etching solution will randomly penetrate through the hydrolysis products creating voids (not shown) in the hydrolytic film and undercutting the electrode formed as shown in FIG. 2.

Figure 2:
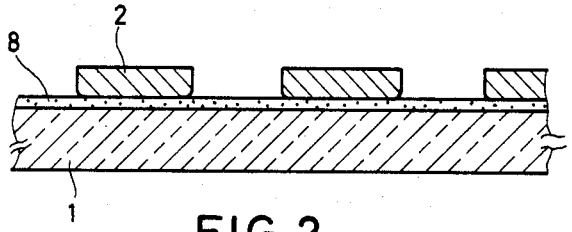
FIG. 2 is a cross-sectional view of a surface of a glass substrate exhibiting products of hydrolysis.

In FIG. 2, there is shown the glass substrate 1, the transparent electrodes 2, and the hydrolytic product or film 8. The edges of the transparent electrodes 2 are shown undercut by the etching solution. Such edges are not suitable for some thin ;ayers of the EL display element because a high electric field is applied between the layers. Therefore, coverage by a insulating film at the etched edge is very important.

A very high electric field is also concentrated at the incomplete covered sites (voids) so as to cause dielectric breakdown. Our experiences show that the thin hydrolytic films formed on the glass substrate by the hydrolytic products tend to contain these voids which reduce the electric resistance of the films.

Figure 3:
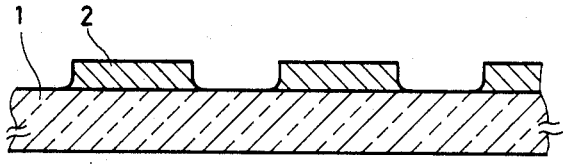
FIG. 3 is a cross-sectional view of a surface of a glass substrate without the products of hydrolysis, according to the present invention.

According to the present invention, the glass substrate is not soaked in any acidic solution, such as hydrofluoric acid, so that no hydrolytic products are formed on the surface of the glass substrate 1 after the grinding steps. The transparent electrodes 2 are exposed to the etching procedure. FIG. 3 shows a cross-sectional view of the glass substrate without the hydrolysis products, according to the present invention. As shown in FIG. 3, the etched edges of the transparent electrode strips 2 are gradual because of the absence of the hydrolytic product of film. Further, due to the absence of the hydrolytic film the final product is not incumbered by the voids present when such a film is present.

Figure 1:
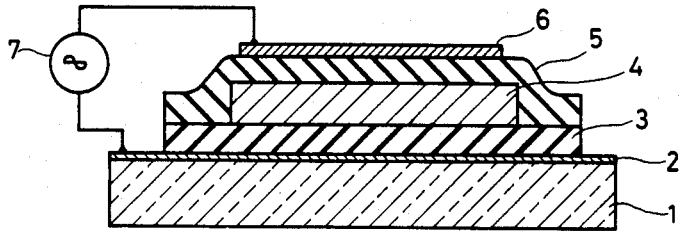
FIG.1 PRIOR ART
FIG. 1 is a cross-sectional view of a prior art thin-film electroluminescent (EL) display panel.
Figure 4:
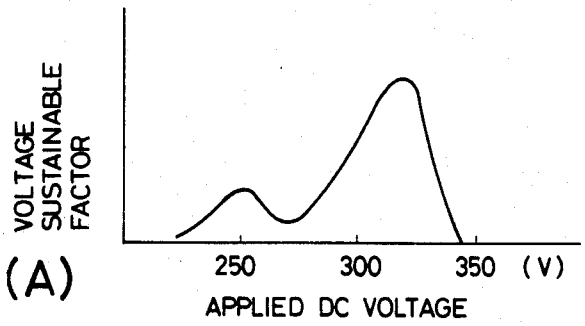
FIGS. 4(A), 4(B) and 4(C) are graphs, showing a relation between DC voltages applied to the EL display element of FIG. 1 and a voltage sustainable factor in connection with a different kind of glass substrate.
Figure 4:
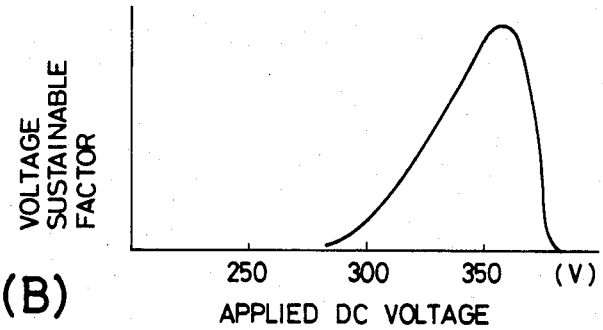
Figure 4:
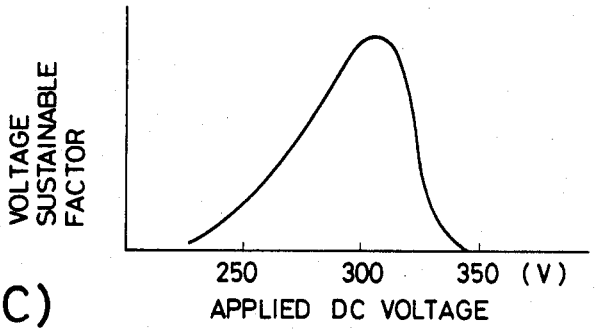

FIGS. 4(A) to 4(C) show a graph representing a relation between DC voltages applied to the EL display element of FIG. 1 and a voltage sustainable factor in connection with a different kind of glass substrate. In the graph of FIG. 4(A), a glass substrate with a hydrolytic product is used. In the graph of FIG. 4(B), a glass substrate without the hydrolytic product is used. In the graph of FIG. 4(C), the conventional glass substrate fire-polished is used.

The graph of FIG. 4(B) shows an improved voltage sustainable factor, enough to improve the factor up to about 50 V as compared with that of FIG. 4(C). The graph of FIG. 4(A) indicates the generation of the dielectric breakdown at the transparent electrode edges. The graph of FIG. 4(A) shows a poor voltage sustainable factor to totally reduce the factor about 20 V as compared with that of FIG. 4(C). In conclusion, the characteristics of FIG. 4(B) are superior to the others.

Figure 5:
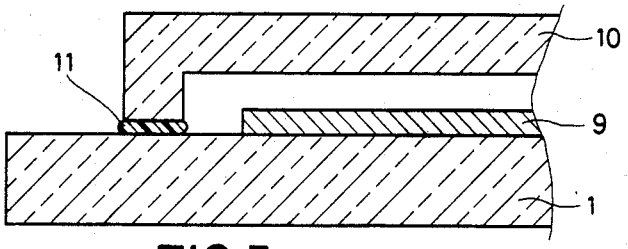
FIG. 5 is a cross-sectional view of a shealding structure for the EL display element of FIG. 1.

FIG. 5 shows a cross-sectional view of a shielded EL display panel comprising a first glass substrate 1 and a second plate-shaped glass substrate 10 defining a EL display element 9 as shown in FIG. 1. The shielded structure is necessary to completely protect the EL display element 9 from moisture introduction from the ambient. The moisture damages the picture element 9 of the EL display element 1. An organic adhesive 11 is provided for bonding thet substrates 1 and 10. The organic adhesive 11 is selected to be a photo curing resin, for example. In using the organic adhesive 11, it is very necessary to provide a very thin layer of the adhesive 11.

On the conventional fire-polished glass substrate, the surface of which is very curved, the thickness of the organic adhesive 11 is varied from about 10 to 300 μm. To the contrary, on the very flat glass substrate free of fire polishing according to the present invention, the thickness of the organic adhesive 11 can be as thin as about 10 to 20 μm. The thickness can be more precisely controlled. This helps to prevent any small moisture introduction through the bonding portion of the substrates 1 and 10. Therefore, the EL display element resistance to moisture becomes about three times or more as long as the conventionally-shielded EL display panel.

While only certain embodiments of the present invention have been described, it will be apparent to those skilled in the art that various changes and modifications may be made therein without departing from the spirit and scope of the invention as claimed.

What is claimed is:

1. A method for preparing an electroluminescent (EL) display element comprising the steps of:

providing a glass substrate made of borosilicic acid;

subjecting at least one surface of said glass substrate to a first primary grinding;

subjecting said at least one surface of said primary ground glass substrate to a second grinding of a photo-mask grade, cleaning said ground surface of said glass substrate with a non-acidic solution followed by drying with freon vapors such that said prepared surface of said glass substrate is free of hydrolytic products; and providing in succession a transparent electrode formed on said cleaned surface of said glass substrate, first and second dielectric layers defining therebetween a EL thin film, and a counter electrode formed on said second dielectric layer so as to prepare said electroluminescent display element.

* * * * *